US012583490B2

(12) United States Patent
Szymanski et al.

(10) Patent No.: US 12,583,490 B2
(45) Date of Patent: Mar. 24, 2026

(54) YOKE ASSEMBLY FOR A COUPLER SYSTEM

(71) Applicant: Transportation IP Holdings, LLC, Norwalk, CT (US)

(72) Inventors: Stéphane Szymanski, Neuville-en-Ferrain (FR); Benjamin Guthrie, Duncan, SC (US); Dan Diaconu, Neuville-en-Ferrain (FR); Timothy Edward Johnson, Duncan, SC (US); Henry Lynn, III, Duncan, SC (US)

(73) Assignee: Transportation IP Holdings, LLC, Norwalk, CT (US)

( * ) Notice: Subject to any disclaimer, the term of this patent is extended or adjusted under 35 U.S.C. 154(b) by 857 days.

(21) Appl. No.: 17/881,024

(22) Filed: Aug. 4, 2022

(65) Prior Publication Data

US 2023/0063070 A1 Mar. 2, 2023

Related U.S. Application Data

(60) Provisional application No. 63/237,245, filed on Aug. 26, 2021.

(51) Int. Cl.

| | |
|---|---|
| ***B61G 9/10*** | (2006.01) |
| ***B61G 7/10*** | (2006.01) |
| ***B61G 9/22*** | (2006.01) |

(52) U.S. Cl.
CPC ..... *B61G 9/10* (2013.01); *B61G 7/10* (2013.01); *B61G 9/22* (2013.01)

(58) Field of Classification Search
CPC ... B61G 7/06; B61G 7/08; B61G 7/10; B61G 9/04; B61G 9/045; B61G 9/06; B61G 9/12; B61G 9/125; B61G 9/10; B61G 9/14; B61G 9/22
See application file for complete search history.

(56) References Cited

U.S. PATENT DOCUMENTS 2,052,993 A * 9/1936 Tomlinson ..... B61G 5/06 213/78

* cited by examiner

*Primary Examiner* — Robert J McCarry, Jr.
(74) *Attorney, Agent, or Firm* — K&L Gates LLP

(57) ABSTRACT

A yoke assembly includes an outer housing having opposite front and rear ends and can define an interior chamber between the front end and the rear end. The yoke assembly also can include a guiding sliding bushing disposed in the interior chamber of the outer housing, a guide rod extending through the interior chamber of the outer housing and through the guiding sliding bushing, a bumper assembly coupled with one end of the guide rod, and an elastomeric body and/or a resilient body disposed within the outer housing between the guiding sliding bushing and the rear end of the outer housing. The bumper assembly can be positioned to be engaged by a mechanical head of a first coupler system of a first vehicle to position a first hook of the first coupler system for coupling with a second hook of a second coupler system of a second vehicle.

19 Claims, 4 Drawing Sheets

YOKE ASSEMBLY FOR A COUPLER SYSTEM

CROSS-REFERENCE TO RELATED APPLICATIONS

This application claims priority to U.S. Provisional Application No. 63/237,245 (filed 26 Aug. 2021), the entire disclosure of which is incorporated herein by reference.

BACKGROUND

Technical Field

The subject matter described herein relates to yokes for couplers that connect vehicles to each other.

Discussion of Art

Couplers are used to connect vehicles with each other for travel along routes. The couplers can include mechanical heads with hooks that are connected to yokes by pins (e.g., clevis pins). The heads have "duck bill" flanges below the clevis pins that contact yokes. The yokes include guide rods that are biased by springs within the bodies of the yokes. The guide rods and springs absorb impact of the heads and can help to position the hooks within the heads at the proper height above rail and alignment for coupling with the hook of another rail vehicle. The yokes can help to align the hooks by the springs applying a bias to the guide rods, which is then applied to the heads and pivot the hooks about or around the pins.

The heads that contact the yokes can include wear plates that contact ends of the guide rods in the yokes. These wear plates can wear down over time and require replacement. The yoke bodies also can include wear rings along internal surfaces of the yoke bodies. Spring retainers that extend around the guide rods in the yoke bodies can contact the wear rings. Misalignment between the hooks of the couplers can cause the spring retainers to wear down or damage the wear rings over time. This wear also can result in misalignment of the guide rod within the yoke body. These misalignments can impede coupling of the coupler hooks with each other, require more frequent repair or maintenance of the yokes and other components, and otherwise interfere with safe and reliable operation of the couplers.

BRIEF DESCRIPTION

In one embodiment, a yoke assembly includes an outer housing having a front end and an opposite rear end. The housing can define an interior chamber between the front end and the rear end. The yoke assembly also can include a guiding sliding bushing disposed in the interior chamber of the outer housing, a guide rod extending through the interior chamber of the outer housing and through the guiding sliding bushing, a bumper assembly coupled with one end of the guide rod, and an elastomeric body and/or a resilient body disposed within the outer housing between the guiding sliding bushing and the rear end of the outer housing. The bumper assembly can be positioned to be engaged by a mechanical head of a first coupler system of a first vehicle to position a first hook of the first coupler system for coupling with a second hook of a second coupler system of a second vehicle.

In one embodiment, a yoke assembly includes an outer housing having a front end and an opposite rear end. The housing can define an interior chamber between the front end and the rear end. The yoke assembly also can include a guide rod extending through the interior chamber of the outer housing, a bumper assembly coupled with one end of the guide rod, and an elastomeric body and/or a resilient body disposed within the outer housing around the guide rod. The bumper assembly can be positioned to be engaged by a mechanical head of a first coupler system of a first vehicle to position a first hook of the first coupler system for coupling with a second hook of a second coupler system of a second vehicle. The bumper assembly and the guide rod can be configured to move within the interior chamber of the outer housing from engagement of the bumper assembly with the mechanical head with the one or more of the elastomeric body or the resilient body being compressed to compensate for different heights of the second hook of the second coupler system of the second rail vehicle.

In one embodiment, a yoke assembly includes an outer housing having a front end and an opposite rear end. The housing can define an interior chamber between the front end and the rear end. The yoke assembly also can include a guiding sliding bushing disposed in the interior chamber of the outer housing, a guide rod extending through the interior chamber of the outer housing and through the guiding sliding bushing, a bumper assembly coupled with one end of the guide rod, and one or more of an elastomeric body or a resilient body disposed within the outer housing between the guiding sliding bushing and the rear end of the outer housing. The bumper assembly can be positioned to be engaged by a mechanical head of a first coupler system of a first vehicle to position a first hook of the first coupler system for coupling with a second hook of a second coupler system of a second vehicle. The bumper assembly, the guide rod, and the guiding sliding bushing can be configured to move within the interior chamber of the outer housing from engagement of the bumper assembly with the mechanical head with the one or more of the elastomeric body or the resilient body being compressed to absorb energy. The bumper assembly, the guide rod, and the guiding sliding bushing can be configured to move within the interior chamber of the outer housing from engagement of the bumper assembly with the mechanical head with the one or more of the elastomeric body or the resilient body being compressed to compensate for different heights of the second hook of the second coupler system of the second rail vehicle. The yoke assembly also can include a safety ring disposed on the guide rod and configured to hold the guiding sliding bushing on the guide rod while the bumper assembly is removed from the guide rod.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
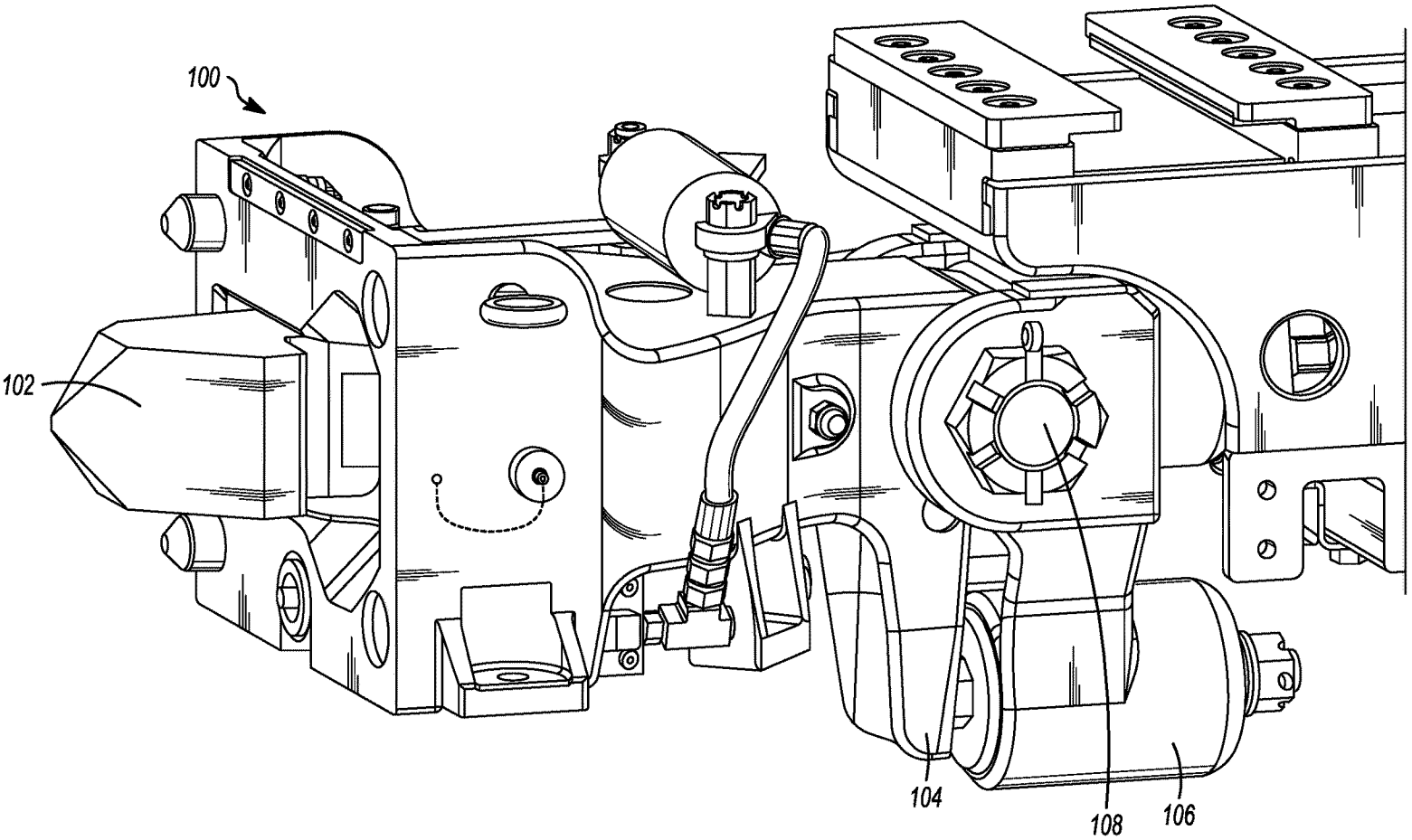
FIG. 1 illustrates one example of a coupler system.

FIG. 1 illustrates one example of a coupler system 100. The coupler system is secured to a rail vehicle and includes a hook 102 that engages a similar hook of another coupler to connect one rail vehicle with another rail vehicle (also called coupling mechanism) for travel together. The hook is a component of the mechanical head 104 that contacts a yoke 106. The hook and head can move (e.g., pivot) about a pin 108 that connects the coupler system with the rail vehicle. The yoke assembly includes a spring that absorbs impact of the head against a guide rod of the yoke assembly.

Figure 2:
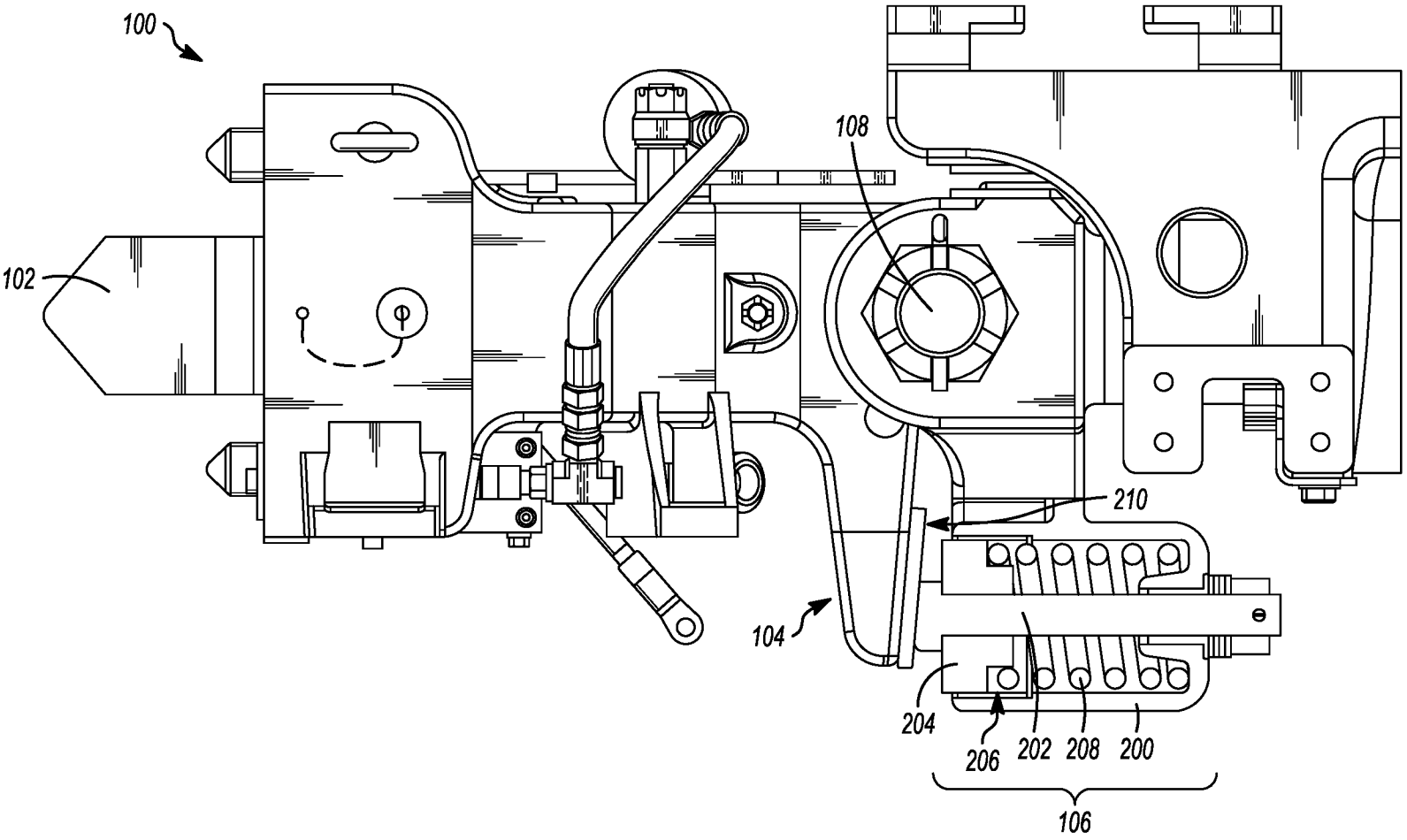
FIG. 2 illustrates a cross-sectional view of the coupler system shown in FIG. 1 and one example of the yoke also shown in FIG. 1.

FIG. 2 illustrates a cross-sectional view of the coupler system shown in FIG. 1 and one example of the yoke also shown in FIG. 1. The yoke includes a housing or body 200 with a guide rod 202 disposed in the housing. The yoke also includes a spring retainer 204 extending around the guide rod and a wear ring 206 along an interior surface of the housing. A spring 208 is disposed inside the housing of the yoke. The "duck bill" flange of the head can include a wear plate 210 that contacts one end of the guide rod. This contact may impart a force on the guide rod, which is absorbed by compressing the spring within the housing of the yoke. The spring can apply a bias onto the spring retainer and guide rod to push outward on the head. This helps support the hook in the position shown in FIG. 2 for coupling with another hook (e.g., by pivoting the hook about or around the pin).

As described above, however, if the hook of one coupler system is not aligned with the hook of another coupler system (e.g., one hook is higher than the other hook due to wear on wheels of the rail vehicle or other causes), this can cause misalignment of the forces exerted on the guide rod. This can increase the wear on the wear ring, the wear plate, and other components of the yoke assembly. For example, the misalignment can cause the spring and/or spring retainer to contact and rub along the interior surfaces of the housing of the yoke, thereby wearing down the housing.

Figure 3:
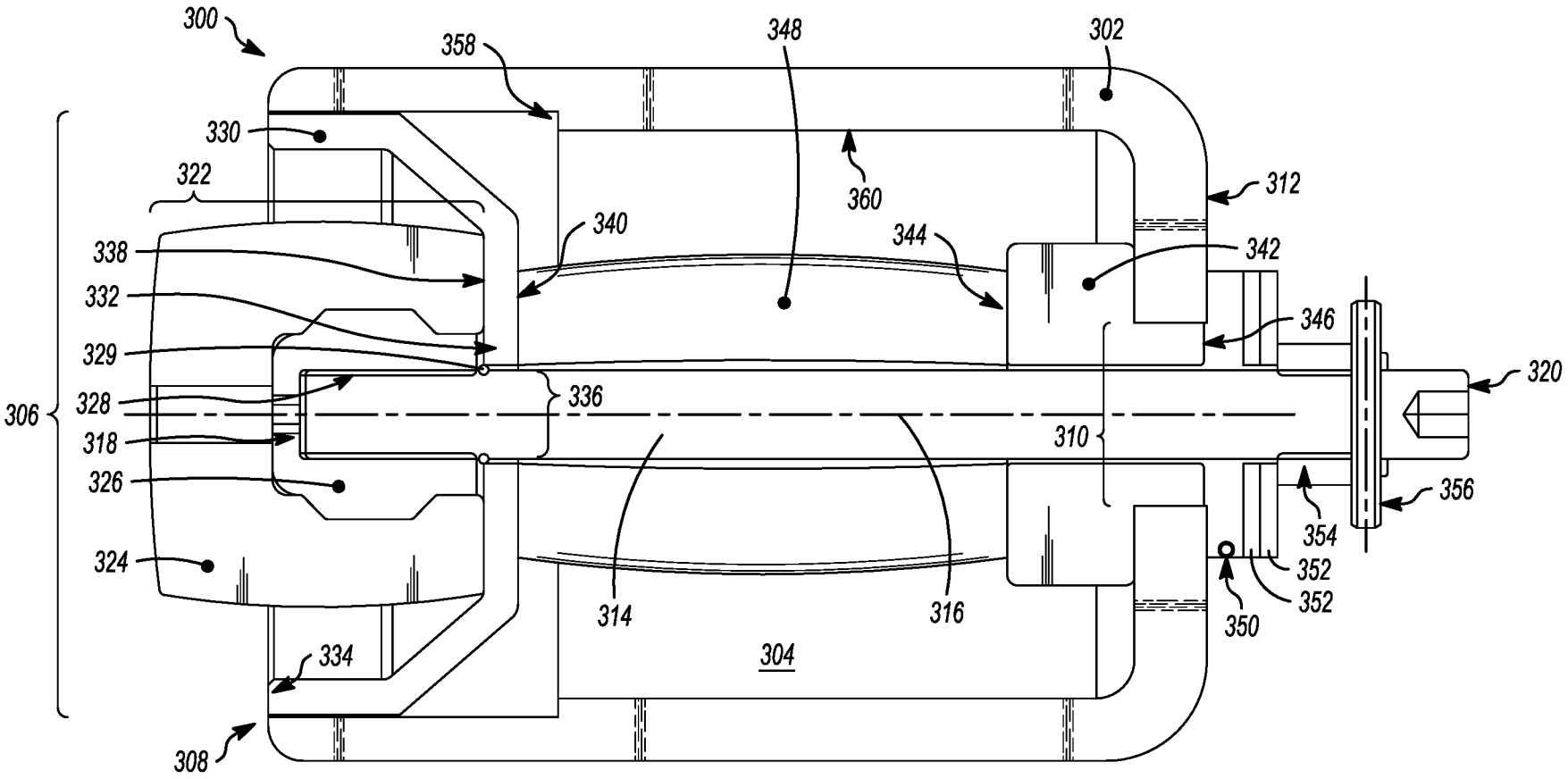
FIG. 3 illustrates a cross-sectional view of one embodiment of an inventive yoke assembly.

FIG. 3 illustrates a cross-sectional view of one embodiment of an inventive yoke assembly 300. The yoke assembly shown in FIG. 3 can be used in place of the yoke 106 shown in FIGS. 1 and 2. For example, the coupler assembly shown in FIGS. 1 and 2 can be manufactured to include the yoke assembly shown in FIG. 3 when supplied new. Optionally, the coupler assembly shown in FIGS. 1 and 2 (or another coupler assembly) can be retrofitted with the yoke assembly shown in FIG. 3 (e.g., by removing the yoke of the existing coupler assembly and replacing the removed yoke with the inventive yoke assembly).

The yoke assembly includes an outer housing 302 that extends around and defines an interior chamber 304. The outer housing can be in the shape of a cylindrical, annular body having a larger opening 306 at a front end 308 of the outer housing and a smaller opening 310 at an opposite rear end 312 of the outer housing. Alternatively, one or both of these openings may have a different size. An inner surface 360 of the outer housing includes a step or shoulder 358 that limits movement of a guiding sliding bushing described below. The step or shoulder is a portion of the inner surface of the outer housing that extends farther into the interior chamber (and closer to a longitudinal axis 316) than the portion of the inner surface of the outer housing that extends from the front end of the housing to the step or shoulder.

A guide rod 314 is an elongated body that extends along (and is longest along) the longitudinal axis 316. The guide rod extends from a front end 318 to an opposite rear end 320. The front end of the guide rod can be closer to the front end of the housing and closer to the head of the coupler assembly than the rear end of the guide rod. The rear end of the guide rod can be closer to the back end of the outer housing, farther from the front end of the outer housing, and farther from the head of the coupler assembly than the front end of the guide rod.

The front end of the guide rod is coupled with a bumper assembly 322. The bumper assembly includes a resilient cap body 324, which is in contact with a coupler head body 104 and connected with a resilient cap insert 326. The resilient cap body can be flexible, or more flexible than the guide rod, outer housing, or resilient cap insert. For example, the resilient cap body can be a rubber or molded rubber body (e.g., a rubber-metal molded part). Alternatively, the resilient cap body can be formed from another material. The resilient cap body can be molded onto, adhered to, or otherwise connected with the coupling body. The resilient cap insert is connected with the front end of the guide rod. For example, the front end of the guide rod can include external threads and an inner surface 328 of the resilient cap insert can include matching internal threads. These external and internal threads can mate with each other to secure the bumper assembly onto the guide rod. A safety ring 329 with a safety function to position on guiding rod for safety of cap body 324 blocking or impeding separation between guiding rod 314 and cap body 324. This safety ring (or snap ring) can hold the guiding sliding bushing (described below) on the guide rod if the bumper assembly is removed.

A guiding sliding bushing or bush 330 is disposed in the interior chamber of the outer housing. This guiding sliding bushing is disposed between the bumper assembly and the rear end of the outer housing. The guiding sliding bushing has an annular cup shape with the bumper assembly at least partially disposed within the cup defined by the guiding sliding bushing. For example, the guiding sliding bushing can extend outward from a radially inner portion 332 to a radially outer portion 334. The radially inner portion is disposed closer to the longitudinal axis and the guide rod than the radially outer portion. Additionally, the radially inner portion is disposed closer to the rear end of the outer housing than the radially outer portion (e.g., along the longitudinal axis). The radially outer portion is disposed farther from the longitudinal axis and the guide rod than the radially inner portion, and the radially outer portion is disposed closer to the front end of the outer housing than the radially inner portion.

The guiding sliding bushing has a forward or outward facing side 338 and an opposite rearward or inward facing side 340. The forward-facing side faces the bumper assembly and away from the rear end of the outer housing. The inward facing side faces away from the bumper assembly and away from the front end of the outer housing. The bumper assembly may abut the forward-facing side of the guiding sliding bushing, as shown in FIG. 3.

The radially outer portion forms an annular shape that extends around the longitudinal axis and through which the bumper assembly may partially protrude out of the outer housing of the yoke assembly. The radially inner portion also forms an annular shape around a central opening 336. The guide rod extends through the central opening defined by the guiding sliding bushing. The wear of cap body 324 is designed so that the cap body can assume the function of the complete yoke by capacity of the polymer spring to absorb energy and in the meantime assure the alignment of two coupler heads at the same height.

The yoke assembly also can include a wear bushing 342 at least partially within the interior volume of the outer housing of the yoke assembly. The wear bushing can be another annular body that extends around the guide rod. The wear bushing extends along the longitudinal axis from a front end 344 to an opposite rear end 346. The front end of the wear bushing faces the inward facing side of the guiding sliding bushing. The rear end of the wear bushing extends into the opening in the rear end of the housing. In the illustrated example, the rear end of the wear bushing is coextensive with the rear end of the housing. Alternatively, the rear end of the wear bushing is not coextensive with the rear end of the housing.

An elastomeric body 348 is disposed within the interior chamber of the outer housing. The elastomeric body can be an annular body that extends around the guide rod (or with the guide rod extending though the opening through a center of the elastomeric body). The elastomeric body can be an annular, elongated body formed from one or more elastomeric materials, such rubber, as one or more rubber-based materials, or materials that include rubber. The elastomeric body extends from the inner facing side of the guiding sliding bushing to the front end of the wear bushing. Optionally, one or more gaps may be between an end of the elastomeric body and one or more of the guiding sliding bushing and/or the wear bushing. Alternatively, the elastomeric body can be replaced by one or more resilient devices or bodies, such as a compression spring, Belleville washer, or the like.

One or more annular bodies (e.g., a flexible ring 350, washers 352, and/or a nut 354, such as a Hong Kong nut) and a yoke pin 356 can be located between the rear end of the outer housing and the back end of the guide rod. This yoke pin can be inserted through an opening or channel radially extending through the guide rod. The guide rod can be positioned through openings in the annular bodies with the pin holding the annular bodies against the outer housing. The flexible ring can be formed from one or more elastomers, such as rubber.

The flexible ring, elastomeric body, and the resilient cap body can be formed of materials that are flexible or more flexible than the materials from which the outer housing, the coupling body, the guide rod, the guiding sliding bushing, the wear bushing, the washer(s), and/or the nut are formed. For example, the flexible ring, elastomeric body, and/or the resilient cap body can be formed from rubber or a rubber-containing material while the outer housing, the coupling body, the guide rod, the guiding sliding bushing, the wear bushing, the washer(s), and/or the nut are formed from one or more metals.

In operation, the "duck bill" flange of the coupler system engages or abuts the outer end of the bumper assembly of the yoke assembly. This engagement can compress the elastomeric body inside the housing of the yoke assembly. For example, the pressure exerted on the bumper assembly by the mechanical head can push the bumper assembly and the guiding sliding bushing in a direction toward the rear end of the outer housing of the yoke assembly, while the wear bushing remains stationary. The elastomeric body is compressed between the guiding sliding bushing and the wear bushing as the bumper assembly and the guiding sliding bushing move closer to the wear bushing.

Figure 4:
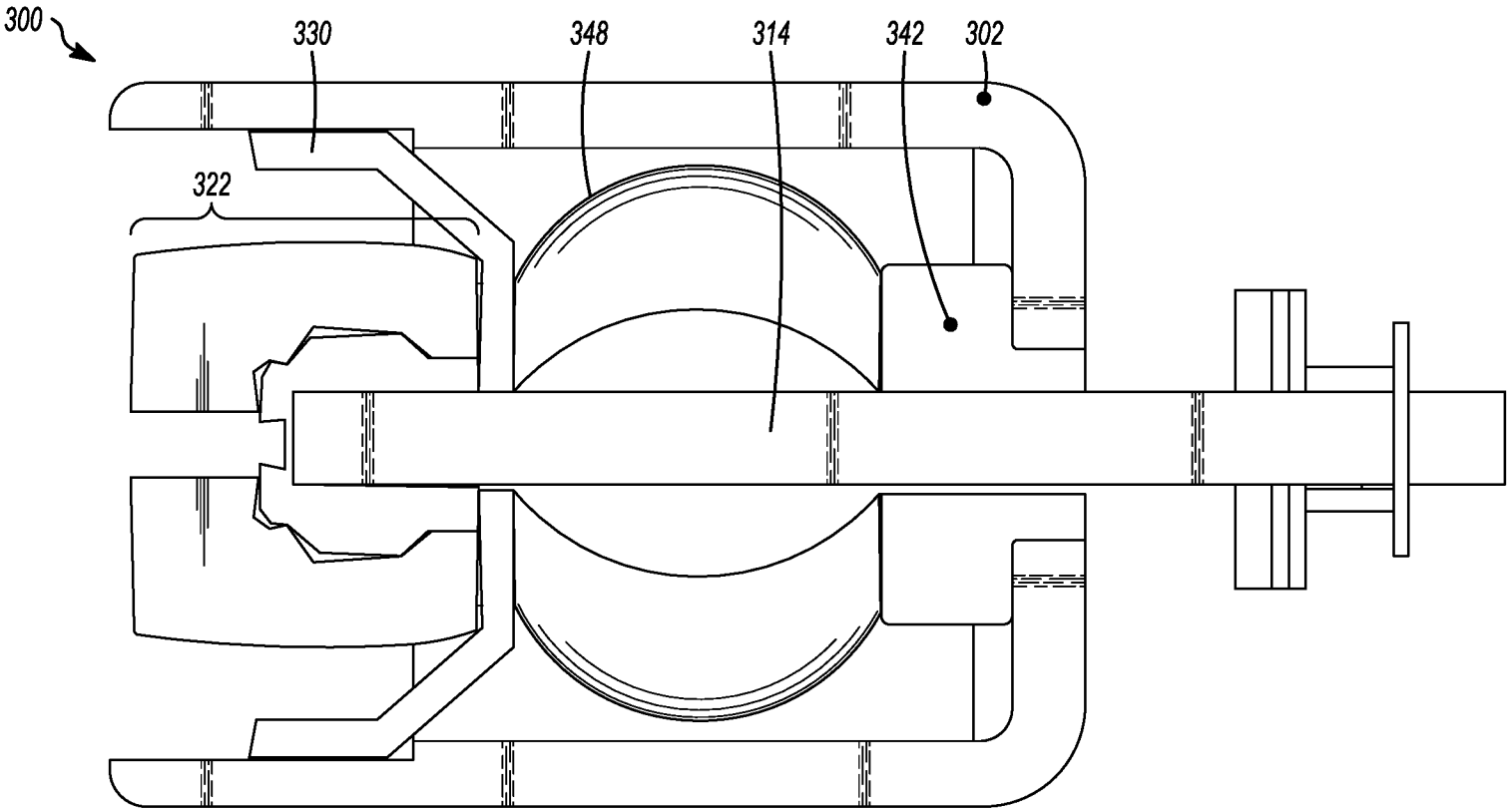
FIG. 4 illustrates one example of the yoke assembly of FIG. 3 with an elastomeric body compressed between a guiding sliding bushing and a wear bushing.

While FIG. 3 illustrates the elastomeric body in a non-compressed state, FIG. 4 illustrates one example of the yoke assembly of FIG. 3 with the elastomeric body compressed between the guiding sliding bushing and the wear bushing. As shown in FIG. 4, the step or shoulder inside the outer housing can limit how far the guiding sliding bushing can move within the outer housing. For example, the distance between the front end of the outer housing and the step or shoulder can be set during manufacture of the housing so that compression of the elastomeric body is limited to a corresponding amount. Forming the outer housing to have the step or shoulder closer to the front end of the housing will result in a smaller limit on the compression of the elastomeric body (e.g., the elastomeric body can be compressed less), while forming the outer housing to have the step or shoulder farther from the front end of the housing will result in a greater limit on the compression of the elastomeric body (e.g., the elastomeric body can be compressed more).

The elastomeric body can absorb the energy imparted by the mechanical head contacting the bumper assembly. This can reduce wear and tear on the yoke assembly relative to more rigid (e.g., metal bodies, such as wear plates) absorbing this energy.

Additionally, the elastomeric body can compensate for differences in height between hooks of different coupler systems. The bumper assembly contacts the "duck bill" flange of the coupler system. Bumper assemblies that protrude farther from the outer housing will contact the "duck bill" flanges farther from the outer housing. This can cause the hooks coupled with the mechanical heads to pivot away from the rail or ground surface farther than for yoke assemblies having bumper heads that do not protrude as far. Consequently, the hooks are positioned higher and farther from the rail or ground surface. Conversely, bumper assemblies that do not protrude as far from the outer housing will contact the "duck bill" flanges closer to the outer housing. This can cause the hooks coupled with the mechanical heads to pivot away from the rail or ground surface by smaller distances than for yoke assemblies having bumper heads that protrude farther out of the housing. Consequently, the hooks are positioned lower and closer from the rail or ground surface.

The distance that the bumper assembly protrudes from the outer housing can be controlled by adding or removing washers between the rear end of the outer housing and the yoke pin. For example, as more washers are added between the housing and the yoke pin, the guide rod moves farther (e.g., toward the right side of FIGS. 3 and 4) and the elastomeric body may be slightly compressed. Additionally, the bumper assembly moves farther to the right (and protrudes less from the housing). Conversely, as fewer washers are between the housing and the yoke pin, the guide rod does not move as far (e.g., toward the right side of FIGS. 3 and 4) and the elastomeric body may be less compressed or not compressed. Additionally, the bumper assembly does not move as far to the right (and protrudes more from the housing).

The elastomeric body can be sized and/or shaped to prevent contact between the elastomeric body and the inner surface of the outer housing. For example, during compression of the elastomeric body, thicker elastomeric bodies may come closer to contacting (e.g., abutting) the inner surface of the outer housing while thinner elastomeric bodies may not come as close to the inner surface (when compressed between the guiding sliding bushing and the wear bushing with the same compressive force). Therefore, the size and/or shape of the elastomeric body can be selected or set, in combination with the location of the step or shoulder inside the outer housing, to prevent the elastomeric body from contacting the inner surface of the outer housing when the elastomeric body is compressed (as shown in FIG. 4). While the elastomeric body may swell or increase in size in radial directions oriented perpendicular to the longitudinal axis, the size and/or shape of the elastomeric body, and/or the location of the step or shoulder in the housing, can be set or controlled to prevent rubbing between the elastomeric body and the inner surface of the outer housing. This can reduce the wear and tear on the inner surface of the housing, thereby extending the useful life of the yoke assembly, reducing downtime of the coupler system for repair or maintenance, and the like.

The bumper assembly can be removed and replaced (or removed and overhauled or repaired) without having to remove the mechanical head of the coupler system or detaching the yoke assembly from the coupler system. As described above, the bumper assembly can be coupled with the guide rod using a threaded connection. Therefore, the bumper assembly may be unscrewed from the guide rod and then either replaced or repaired once the bumper assembly (e.g., the resilient cap body) becomes worn, damaged, or otherwise needs replacement or repair. This can occur without dismantling other components of the coupler system. Because the wear plates on the mechanical heads may be welded to the heads, replacing the wear plates can be time consuming and costly. In contrast, screwing off and replacing the bumper assembly may take less time and be less expensive.

The resilient cap body of the bumper assembly also can reduce audible sounds generated during coupling of two coupling systems. Because the head of the coupler system is impacting the more flexible resilient cap body, and not a more rigid wear plate, the sounds generated during coupling can be reduced using the yoke assembly.

The guide rod is supported in multiple locations within the housing of the yoke assembly. This can reduce the wear and tear on the elastomeric body and thereby increase the useful life of the elastomeric body. For example, the guide rod is supported (e.g., suspended) within the interior chamber of the outer housing by the guiding sliding bushing and the wear bushing. These two supporting locations can restrict the bending of the guide rod in directions that are transverse to the longitudinal action. These two bushings can prevent the guide rod from rotating or pivoting in directions that are transverse to the longitudinal axis. This can prevent the elastomeric body from being twisted or bent in similar directions, which can reduce wear on the elastomeric body.

The components of the yoke assembly can be more easily removed and repaired or replaced when compared to some known yokes. For example, the bumper assembly can be unscrewed from the front end of the guide rod for replacement, as described above. Moreover, the yoke pin can be pulled from the guide rod (e.g., in a radial direction away from the longitudinal axis) to allow for the nut, washers, and ring to be removed from the guide rod. The guide rod, guiding sliding bushing, and bumper assembly can then be removed through the opening in the front end of the housing. The wear bushing can then be accessed through the opening in the front end of the housing. One or more of these components can then be inspected, repaired, or replaced without removing the outer housing of the yoke assembly from the coupler system.

In one embodiment, a yoke assembly includes an outer housing having a front end and an opposite rear end. The housing can define an interior chamber between the front end and the rear end. The yoke assembly also can include a guiding sliding bushing disposed in the interior chamber of the outer housing, a guide rod extending through the interior chamber of the outer housing and through the guiding sliding bushing, a bumper assembly coupled with one end of the guide rod, and an elastomeric body and/or a resilient body disposed within the outer housing between the guiding sliding bushing and the rear end of the outer housing. The bumper assembly can be positioned to be engaged by a mechanical head of a first coupler system of a first vehicle to position a first hook of the first coupler system for coupling with a second hook of a second coupler system of a second vehicle.

The bumper assembly, the guide rod, and the guiding sliding bushing can be configured to move within the interior chamber of the outer housing from engagement of the bumper assembly with the mechanical head with the one or more of the elastomeric body or the resilient body being compressed to absorb energy. The bumper assembly, the guide rod, and the guiding sliding bushing can be configured to move within the interior chamber of the outer housing from engagement of the bumper assembly with the mechanical head with the one or more of the elastomeric body or the resilient body being compressed to compensate for different heights of the second hook of the second coupler system of the second rail vehicle.

The bumper assembly can include a resilient cap body and a coupling body. This resilient cap body can be configured to engage and absorb the energy from impact of the mechanical head. The coupling body can be configured to couple and de-couple from the guide rod for replacement of the bumper assembly. The yoke assembly optionally can also include a wear bushing disposed in the interior chamber of the outer housing with the one or more of the elastomeric body or the resilient body disposed between the guiding sliding bushing and the wear bushing. Each of the wear bushing and the guiding sliding bushing can include an opening through which the guide rod extends. The wear bushing and the guiding sliding bushing can suspend the guide rod in the interior chamber of the outer housing with the one or more of the elastomeric body or the resilient body suspended in the interior chamber of the outer housing around the guide rod.

The guiding sliding bushing can be configured to move within the interior chamber of the outer housing responsive to the bumper assembly being engaged by the mechanical head of the first coupler system. The outer housing can include an inner surface with a step or shoulder that limits a distance that the guiding sliding bushing moves into the interior chamber of the outer housing and that limits compression of the one or more of the elastomeric body or the resilient body. The step or shoulder of the outer housing can limit the compression of the one or more of the elastomeric body or the resilient body such that the one or more of the elastomeric body or the resilient body does not engage the inner surface of the outer housing when compressed.

The outer housing optionally can include an opening in the rear end of the outer housing through which a rear end of the guide rod protrudes. The guide rod can include a yoke pin and one or more annular bodies between the yoke pin and the rear end of the outer housing. The one or more annular bodies can control how far the bumper assembly protrudes out of a front end of the outer housing. The yoke pin can be configured to be removed from the guide rod to permit removal of the one or more annular bodies. The bumper assembly can be configured to be detached from the guide rod to permit removal of the guide rod, the guiding sliding bushing, and the one or more of the elastomeric body or the resilient body from the outer housing. The yoke assembly optionally can include a safety ring disposed on the guide rod and configured to hold the guiding sliding bushing on the guide rod while the bumper assembly is removed from the guide rod.

In one embodiment, a yoke assembly includes an outer housing having a front end and an opposite rear end. The housing can define an interior chamber between the front end and the rear end. The yoke assembly also can include a guide rod extending through the interior chamber of the outer housing, a bumper assembly coupled with one end of the guide rod, and an elastomeric body and/or a resilient body disposed within the outer housing around the guide rod. The bumper assembly can be positioned to be engaged by a mechanical head of a first coupler system of a first vehicle to position a first hook of the first coupler system for coupling with a second hook of a second coupler system of a second vehicle. The bumper assembly and the guide rod can be configured to move within the interior chamber of the outer housing from engagement of the bumper assembly with the mechanical head with the one or more of the elastomeric body or the resilient body being compressed to compensate for different heights of the second hook of the second coupler system of the second rail vehicle.

The yoke assembly optionally can include a guiding sliding bushing disposed in the interior chamber of the outer housing with the guide rod extending through an opening in the guiding sliding bushing and the one or more of the elastomeric body or the resilient body disposed between the guiding sliding bushing and the rear end of the outer housing. The yoke assembly may include a wear bushing disposed in the interior chamber of the outer housing with the one or more of the elastomeric body or the resilient body disposed between the guiding sliding bushing and the wear bushing. Each of the wear bushing and the guiding sliding bushing can include an opening through which the guide rod extends. The wear bushing and the guiding sliding bushing can suspend the guide rod in the interior chamber of the outer housing with the one or more of the elastomeric body or the resilient body suspended in the interior chamber of the outer housing around the guide rod. The guiding sliding bushing can be configured to move within the interior chamber of the outer housing responsive to the bumper assembly being engaged by the mechanical head of the first coupler system. The outer housing can include an inner surface with a step or shoulder that limits a distance that the guiding sliding bushing moves into the interior chamber of the outer housing and that limits compression of the one or more of the elastomeric body or the resilient body. The step or shoulder of the outer housing can limit the compression of the one or more of the elastomeric body or the resilient body such that the one or more of the elastomeric body or the resilient body does not engage the inner surface of the outer housing when compressed.

The yoke assembly optionally can include a safety ring disposed on the guide rod and configured to hold the guiding sliding bushing on the guide rod while the bumper assembly is removed from the guide rod. The bumper assembly and the guide rod can be configured to move within the interior chamber of the outer housing from engagement of the bumper assembly with the mechanical head with the one or more of the elastomeric body or the resilient body being compressed to absorb energy. The bumper assembly can include a resilient cap body and a coupling body. The resilient cap body can be configured to engage and absorb the energy from impact of the mechanical head. The coupling body can be configured to couple and de-couple from the guide rod for replacement of the bumper assembly.

In one embodiment, a yoke assembly includes an outer housing having a front end and an opposite rear end. The housing can define an interior chamber between the front end and the rear end. The yoke assembly also can include a guiding sliding bushing disposed in the interior chamber of the outer housing, a guide rod extending through the interior chamber of the outer housing and through the guiding sliding bushing, a bumper assembly coupled with one end of the guide rod, and one or more of an elastomeric body or a resilient body disposed within the outer housing between the guiding sliding bushing and the rear end of the outer housing. The bumper assembly can be positioned to be engaged by a mechanical head of a first coupler system of a first vehicle to position a first hook of the first coupler system for coupling with a second hook of a second coupler system of a second vehicle. The bumper assembly, the guide rod, and the guiding sliding bushing can be configured to move within the interior chamber of the outer housing from engagement of the bumper assembly with the mechanical head with the one or more of the elastomeric body or the resilient body being compressed to absorb energy. The bumper assembly, the guide rod, and the guiding sliding bushing can be configured to move within the interior chamber of the outer housing from engagement of the bumper assembly with the mechanical head with the one or more of the elastomeric body or the resilient body being compressed to compensate for different heights of the second hook of the second coupler system of the second rail vehicle. The yoke assembly also can include a safety ring disposed on the guide rod and configured to hold the guiding sliding bushing on the guide rod while the bumper assembly is removed from the guide rod.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A yoke assembly comprising:

an outer housing having a front end and an opposite rear end, the housing defining an interior chamber between the front end and the rear end;

a guiding sliding bushing disposed in the interior chamber of the outer housing;

a guide rod extending through the interior chamber of the outer housing and through the guiding sliding bushing;

a bumper assembly coupled with one end of the guide rod; and one or more of an elastomeric body or a resilient body disposed within the outer housing between the guiding sliding bushing and the rear end of the outer housing, the bumper assembly positioned to be engaged by a mechanical head of a first coupler system of a first rail vehicle to position a first hook of the first coupler system for coupling with a second hook of a second coupler system of a second rail vehicle, wherein the outer housing includes an opening in the rear end of the outer housing through which a rear end of the guide rod protrudes, the guide rod including a yoke pin and one or more annular bodies between the yoke pin and the rear end of the outer housing.

2. The yoke assembly of claim 1, wherein the bumper assembly, the guide rod, and the guiding sliding bushing are configured to move within the interior chamber of the outer housing from engagement of the bumper assembly with the mechanical head with the one or more of the elastomeric body or the resilient body being compressed to absorb energy.

3. The yoke assembly of claim 1, wherein the bumper assembly, the guide rod, and the guiding sliding bushing are configured to move within the interior chamber of the outer housing from engagement of the bumper assembly with the mechanical head with the one or more of the elastomeric body or the resilient body being compressed to compensate for different heights of the second hook of the second coupler system of the second rail vehicle.

4. The yoke assembly of claim 1, wherein the bumper assembly includes a resilient cap body and a coupling body, the resilient cap body configured to engage and absorb the energy from impact of the mechanical head, the coupling body configured to couple and de-couple from the guide rod for replacement of the bumper assembly.

5. The yoke assembly of claim 1, further comprising:

a wear bushing disposed in the interior chamber of the outer housing with the one or more of the elastomeric body or the resilient body disposed between the guiding sliding bushing and the wear bushing.

6. The yoke assembly of claim 1, wherein the guiding sliding bushing is configured to move within the interior chamber of the outer housing responsive to the bumper assembly being engaged by the mechanical head of the first coupler system, the outer housing including an inner surface with a step or shoulder that limits a distance that the guiding sliding bushing moves into the interior chamber of the outer housing and that limits compression of the one or more of the elastomeric body or the resilient body.

7. The yoke assembly of claim 6, wherein the step or shoulder of the outer housing limits the compression of the one or more of the elastomeric body or the resilient body such that the one or more of the elastomeric body or the resilient body does not engage the inner surface of the outer housing when compressed.

8. The yoke assembly of claim 1, wherein the yoke pin is configured to be removed from the guide rod to permit removal of the one or more annular bodies, and the bumper assembly is configured to be detached from the guide rod to permit removal of the guide rod, the guiding sliding bushing, and the one or more of the elastomeric body or the resilient body from the outer housing.

9. The yoke assembly of claim 1, further comprising:

a safety ring disposed on the guide rod and configured to hold the guiding sliding bushing on the guide rod while the bumper assembly is removed from the guide rod.

10. A yoke assembly comprising:

an outer housing having a front end and an opposite rear end, the housing defining an interior chamber between the front end and the rear end;

a guide rod extending through the interior chamber of the outer housing;

a bumper assembly coupled with one end of the guide rod; and a guiding sliding bushing disposed in the interior chamber of the outer housing with the guide rod extending through an opening in the guiding sliding bushing and the one or more of the elastomeric body or the resilient body disposed between the guiding sliding bushing and the rear end of the outer housing, one or more of an elastomeric body or a resilient body disposed within the outer housing around the guide rod, the bumper assembly positioned to be engaged by a mechanical head of a first coupler system of a first rail vehicle to position a first hook of the first coupler system for coupling with a second hook of a second coupler system of a second rail vehicle, the bumper assembly and the guide rod are configured to move within the interior chamber of the outer housing from engagement of the bumper assembly with the mechanical head with the one or more of the elastomeric body or the resilient body being compressed to compensate for different heights of the second hook of the second coupler system of the second rail vehicle.

11. The yoke assembly of claim 10, further comprising:

a wear bushing disposed in the interior chamber of the outer housing with the one or more of the elastomeric body or the resilient body disposed between the guiding sliding bushing and the wear bushing.

12. The yoke assembly of claim 11, wherein each of the wear bushing and the guiding sliding bushing include an opening through which the guide rod extends, the wear bushing and the guiding sliding bushing suspending the guide rod in the interior chamber of the outer housing with the one or more of the elastomeric body or the resilient body suspended in the interior chamber of the outer housing around the guide rod.

13. The yoke assembly of claim 10, wherein the guiding sliding bushing is configured to move within the interior chamber of the outer housing responsive to the bumper assembly being engaged by the mechanical head of the first coupler system, the outer housing including an inner surface with a step or shoulder that limits a distance that the guiding sliding bushing moves into the interior chamber of the outer housing and that limits compression of the one or more of the elastomeric body or the resilient body.

14. The yoke assembly of claim 13, wherein the step or shoulder of the outer housing limits the compression of the one or more of the elastomeric body or the resilient body such that the one or more of the elastomeric body or the resilient body does not engage the inner surface of the outer housing when compressed.

15. The yoke assembly of claim 10, further comprising:

a safety ring disposed on the guide rod and configured to hold the guiding sliding bushing on the guide rod while the bumper assembly is removed from the guide rod.

16. The yoke assembly of claim 10, wherein the bumper assembly and the guide rod are configured to move within the interior chamber of the outer housing from engagement of the bumper assembly with the mechanical head with the one or more of the elastomeric body or the resilient body being compressed to absorb energy.

17. A yoke assembly comprising:

an outer housing having a front end and an opposite rear end, the housing defining an interior chamber between the front end and the rear end;

a guiding sliding bushing disposed in the interior chamber of the outer housing;

a guide rod extending through the interior chamber of the outer housing and through the guiding sliding bushing;

a bumper assembly coupled with one end of the guide rod; and one or more of an elastomeric body or a resilient body disposed within the outer housing between the guiding sliding bushing and the rear end of the outer housing, the bumper assembly positioned to be engaged by a mechanical head of a first coupler system of a first rail vehicle to position a first hook of the first coupler system for coupling with a second hook of a second coupler system of a second rail vehicle, wherein the bumper assembly, the guide rod, and the guiding sliding bushing are configured to move within the interior chamber of the outer housing from engagement of the bumper assembly with the mechanical head with the one or more of the elastomeric body or the resilient body being compressed to absorb energy, wherein the bumper assembly, the guide rod, and the guiding sliding bushing are configured to move within the interior chamber of the outer housing from engagement of the bumper assembly with the mechanical head with the one or more of the elastomeric body or the resilient body being compressed to compensate for different heights of the second hook of the second coupler system of the second rail vehicle.

18. The yoke assembly of claim 17, further comprising:

a safety ring disposed on the guide rod and configured to hold the guiding sliding bushing on the guide rod while the bumper assembly is removed from the guide rod.

19. A yoke assembly comprising:

an outer housing having a front end and an opposite rear end, the housing defining an interior chamber between the front end and the rear end;

a guiding sliding bushing disposed in the interior chamber of the outer housing;

a guide rod extending through the interior chamber of the outer housing and through the guiding sliding bushing;

a bumper assembly coupled with one end of the guide rod;

one or more of an elastomeric body or a resilient body disposed within the outer housing between the guiding sliding bushing and the rear end of the outer housing, the bumper assembly positioned to be engaged by a mechanical head of a first coupler system of a first rail vehicle to position a first hook of the first coupler system for coupling with a second hook of a second coupler system of a second rail vehicle; and a safety ring disposed on the guide rod and configured to hold the guiding sliding bushing on the guide rod while the bumper assembly is removed from the guide rod.

* * * * *